US006810358B1

(12) United States Patent
Lang et al.

(10) Patent No.: US 6,810,358 B1
(45) Date of Patent: Oct. 26, 2004

(54) METHOD TO SYNCHRONIZE DATA WHEN USED FOR INPUT/LOSS PERFORMANCE MONITORING OF A POWER PLANT

(75) Inventors: Fred D Lang, San Rafael, CA (US); Gary Hoenig, Santa Rosa, CA (US)

(73) Assignee: Exergetic Systems LLC, San Rafael, CA (US)

( * ) Notice: Subject to any disclaimer, the term of this patent is extended or adjusted under 35 U.S.C. 154(b) by 206 days.

(21) Appl. No.: 09/970,489

(22) Filed: Oct. 3, 2001

Related U.S. Application Data

(63) Continuation-in-part of application No. 09/827,956, filed on Apr. 4, 2001, now Pat. No. 6,560,563, which is a continuation-in-part of application No. 09/759,061, filed on Jan. 11, 2001, now abandoned, which is a continuation-in-part of application No. 09/273,711, filed on Mar. 22, 1999, now Pat. No. 6,522,994, which is a continuation-in-part of application No. 09/047,198, filed on Mar. 24, 1998, now abandoned, application No. 09/970,489, which is a continuation-in-part of application No. 09/630,853, filed on Aug. 2, 2000, now Pat. No. 6,584,429, application No. 09/970,489, which is a continuation-in-part of application No. 09/273,711, which is a continuation-in-part of application No. 09/047,198.

(60) Provisional application No. 60/147,717, filed on Aug. 6, 1999.

(51) Int. Cl.[7] ..... G01D 18/00; G06F 11/30

(52) U.S. Cl. ..... 702/182; 702/31; 702/89; 700/274; 700/287

(58) Field of Search ..... 702/22–25, 27, 702/30–32, 84, 108, 116–118, 182–185, 187; 700/266, 274, 287; 701/99; 110/185, 186, 188, 190, 191

(56) References Cited

U.S. PATENT DOCUMENTS

| | | | | | |
|---|---|---|---|---|---|
| 4,096,575 | A | * | 6/1978 | Itoh | 702/89 |
| 4,348,732 | A | * | 9/1982 | Kreft | 702/27 |
| 4,423,487 | A | * | 12/1983 | Buckenham et al. | 702/182 |
| 5,280,756 | A | * | 1/1994 | Labbe | 110/191 |
| 5,367,470 | A | * | 11/1994 | Lang | 700/274 |
| 5,703,489 | A | * | 12/1997 | Kuroe | 324/601 |
| 5,740,200 | A | * | 4/1998 | Kamata | 375/224 |
| 5,790,420 | A | * | 8/1998 | Lang | 700/287 |
| 5,815,689 | A | * | 9/1998 | Shaw et al. | 713/400 |
| 5,970,426 | A | * | 10/1999 | Mandel et al. | 702/32 |
| 6,435,019 | B1 | * | 8/2002 | Vojtisek-Lom | 73/118.1 |

* cited by examiner

*Primary Examiner*—Marc S. Hoff
*Assistant Examiner*—Manuel L. Barbee

(57) ABSTRACT

The operation of a fossil-fired thermal system is quantified by recognizing and correcting data collections which must be synchronized to improve the accuracy of analytical models which determine fuel chemistry, fuel heating value, boiler efficiency, fuel energy flow and/or system heat rate.

5 Claims, 2 Drawing Sheets

METHOD TO SYNCHRONIZE DATA WHEN USED FOR INPUT/LOSS PERFORMANCE MONITORING OF A POWER PLANT

This application is a Continuation-In-Part of U.S. patent application Ser. No. 09/273,711 filed Mar. 22, 1999, which issued on Feb. 18, 2003 as U.S. Pat. No. 6,522,994, for which priority is claimed and is incorporated herein by reference in its entirety; application Ser. No. 09/273,711 which, in turn, is a Continuation-In-Part of U.S. patent application Ser. No. 09/047,198 filed Mar. 24, 1998, now abandoned, This application is also a Continuation-In-Part of U.S. patent application Ser. No. 09/630,853 filed Aug. 2, 2000, which issued on Jun. 24, 2003 as U.S. Pat. No. 6,584,429, for which priority is claimed and is incorporated herein by reference in its entirety; application Ser. No. 09/630,853 claims the benefit of U.S. Provisional Patent Application Ser. No. 60/147,717 filed Aug. 6, 1999, now abandoned.

This application is also a Continuation-In-Part of U.S. patent application Ser. No. 09/827,956 filed Apr. 4, 2001, which issued on May 6, 2003 as U.S. Pat. No. 6,560,563, for which priority is claimed and is incorporated herein by reference in its entirety; application Ser. No. 09/827,956 which, in turn, is a Continuation-In-Part of U.S. patent application Ser. No. 09/759,061 filed Jan. 11, 2001, now abandoned; application Ser. No. 09/759,061 which, in turn, is a Continuation-In-Part of U.S. patent application Ser. No. 09/273,711 filed Mar. 22, 1999, for which priority is claimed and is incorporated herein by reference in its entirety; application Ser. No. 09/273,711 which, in turn, is a Continuation-In-Part of U.S. patent application Ser. No. 09/047,198 filed Mar. 24, 1998, now abandoned.

This invention relates to a fossil-fired thermal system such as a power plant or steam generator, and, more particularly, to a method to synchronize data obtained from such systems. Particularly this invention relates to how synchronized data is corrected, given that these corrections are needed by established methods which describe, in real time, fuel chemistry, heating value, boiler efficiency, fuel energy flow, L Factors, $F_C$ Factors, and/or system heat rate.

BACKGROUND OF THE INVENTION

The importance of determining a fossil-fired thermal system's heat rate is critical if practical hour-by-hour improvements in heat rate are to be made, and/or problems in thermally degraded equipment within the system are to be found and corrected (note that heat rate is inversely related to system efficiency as: Heat Rate (Btu/kWh)=3412.1416/Efficiency). Analytical tools are available which allow in real time the determination of related thermal performance parameters. These are described in one or more of the following U.S. Pat. No. 6,522,994 (hereinafter termed '711 after its application Ser. No. 09/273,711), U.S. Pat. No. 6,584,429 (hereinafter termed '853 after its application Ser. No. 09/630,853), and U.S. Pat. No. 6,560,563 (hereinafter termed '956 after its application Ser. No. 09/827,956). '711 describes calculating in an explicit manner a fuel chemistry and fuel heating value of a fossil-fired thermal system using the Input/Loss Method; said fuel chemistry includes elementary fuel constituents, fuel water and fuel ash concentrations whose explicit computations are principally based on combustion effluents. '853 describes determining a boiler efficiency of a fossil-fired thermal system using the Input/Loss Method as comprising an Enthalpy of Products term, an Enthalpy of Reactants term, and a Firing Correction term all referenced to the fuel's calorific temperature. '956 describes determining a heat rate of the fossil-fired system using the L Factor method as comprising a corrected L Factor, a corrected total effluents mass flow rate and a produced electrical power. However, the process of determining chemistry and heating value of a fossil fuel, such as coal, in real time is strongly dependent on measurements of effluent $CO_2$ and $O_2$, in addition to other "operating parameters" defined herein, and also discussed in '711. Data signals from instrumentation measuring these quantities may often be delayed in time relative to other data due to one or more of the following circumstances: physical measurement techniques; delays in non-uniform storage of data; and/or having an incorrect time stamp associated with the beginning or end of data averaging (versus, for example, a mid-point time or instantaneous time associated with other data).

This invention teaches through data synchronization techniques to correct time delays in data when such data is used to determine fossil fuel chemistry, heating value, boiler efficiency, fuel energy flow and/or system heat rate. Before the advance of technology allowing for such determinations, data synchronization as taught by this invention was not needed. However, established analytical tools employing these technologies, as learned during the course of developing this invention, require correction to achieve acceptable accuracies. Such established analytical tools used to determine fuel chemistry, heating value, boiler efficiency, fuel energy flow, system heat rate, L Factors, $F_C$ Factors, and related parameters, are discussed at length in '711, '853 and '956.

Analytical tools commercially available which claim to determine fuel chemistry, fuel heating value, fuel energy flow and/or system heat rate in real time include at least the following: the Input/Loss Method offered by Exergetic Systems, Inc. of San Rafael, Calif.; the OPTIMAX system offered by ABB Power Automation Ltd., Baden, Switzerland; the PMAX system offered by ScienTech, Inc., Idaho Falls, Id.; the L Factor Method offered by Exergetic Systems, Inc. of San Rafael, Calif.; the F Factor Method promoted by the Energy Research Center, Lehigh University, Bethlehem, Penn.; methods promoted by the Center for Electric Power, Tennessee Technological University, Cookeville, Tenn.; and any other method determining fuel chemistry, fuel heating value, fuel energy flow or heat rate in real time for thermal systems burning fossil fuels, and especially for system burning coal fuels. A rudimentary Input/Loss Method is described in U.S. Pat. No. 5,367,470 issued Nov. 22, 1994 (hereinafter termed '470), and in U.S. Pat. No. 5,790,420 issued Aug. 4, 1998 (hereinafter termed '420).

There is no known art to the present invention. None of the aforementioned commercial offerings, nor '470 and '420, nor '711, '853 and '956 and their related provisional patent applications and Continuation-In-Parts, teach any corrective techniques leading to data synchronization as is important when determining fossil fuel chemistry on-line. None of the aforementioned promote nor advance the idea that data synchronization is even required at the conceptual level. For situations involving power plant or steam generator monitoring using the Input/Loss Method, or similar method, but not addressing data synchronization the accuracy and performance of such methods may be flawed.

SUMMARY OF THE INVENTION

In applying the teachings of '711 and '956 at coal-fired power plants, it has become apparent in developing the methods of this invention that the on-line determination of fuel chemistry and/or fuel heating value is highly sensitivity to effluent measurements, and to their relative consistency in time to each other, that is data with the same time stamp (i.e., the same identifying reference time). The work of this invention has found that data synchronization must be an important consideration when determining fuel chemistry of a fossil-fired thermal system in real-time, and especially as related to the system's operating parameters including effluent measurements. Of these, $CO_2$, $H_2O$ and $O_2$ measurements, following '711 discussion of how these measurements may be obtained, are the most important. However, the methods as taught herein may be applied to all data involved in determining fuel chemistry, fuel heating value and/or system heat rate including the Input/Loss Method.

Data synchronization is especially important if $CO_2$, $H_2O$ and $O_2$ measurements have different time delays. An increase in $CO_2$, other parameters remaining approximately constant, implies a decrease in effluent $O_2$. However, delays in one of these signals, if not corrected, could easily create a situation where both $CO_2$ and $O_2$ signals appear to increase or decrease together as would be observed by an uncorrected data acquisition process. The $H_2O$ is taken herein to be either directly measured at the system's boundary, or otherwise determined. As an example of such sensitivity obtained from a coal-fired power plant, and using methods of '711, consider that a 1.5 minute delay in a $CO_2$ signal resulting in a 1.0% Δmole/mole change, results when averaging data over two minutes in a 2.7% change in computed heating value. If mis-diagnosed in computing a change in heat rate (254 ΔBtu/kWh), assuming a typical worth of $30,000/ΔBtu/kWh/year, this 1.0% sensitivity to delays in data collection is worth $7.62 million/year.

When the monitoring a fossil-fired thermal system involves real time analytical modeling of the fuel being burned, and when such modeling relies in part on effluent measurements, this invention recognizes a strong dependency on the synchronization of effluent $CO_2$, $H_2O$ and $O_2$ measurements. This invention recognizes that effluent $CO_2$, $H_2O$ and $O_2$ measurements must be consistent in time. As taught by '711 the determination of fuel chemistry, fuel heating value and/or fuel energy flow, dependent principally on effluent $CO_2$, $H_2O$ and $O_2$ measurements, are not dependent on measured fuel flow. As taught by '956 the determination of fuel energy flow, when dependent on effluent $CO_2$ measurements, may not be dependent on fuel flow. However, fuel flow is dependent, in part, on working fluid energy flow. Fuel energy flow is determined when fuel flow is multiplied by fuel heating value (fuel energy flow having typical units of Btu/hour). System heat rate is determined when fuel energy flow is divided by a system's power production (system heat rate having typical units of Btu/kWatt-hour). Effluent $CO_2$, $H_2O$ and $O_2$ measurements typically have a physically different data acquisition system (typically central to the placement of these instruments, near the smoke stack), from the system's traditional data acquisition system whose data is used to determine working fluid energy flow. As such, possible time delays in the acquisition of data is not uncommon, and must be considered such that synchronization of data is achieved; from which consistent heat rate may then be determined.

This invention teaches a method for quantifying the operation of a fossil-fired thermal system in which its fuel chemistry, fuel heating value and/or fuel energy flow are being determined by analytical models using system data, whereas the method includes the steps of first obtaining collections of system data, each collection consisting of individual data points. Second it allows for the determination of time delays associated with the individual data points. The method then determines a synchronous and consistent collection of data dependent on time delays associated with the individual data points and the collections of system data. This synchronous collection of data may then be input to analytical models which determine one or more of the following quantities of the fossil-fired thermal system: fuel chemistry, fuel heating value, boiler efficiency, fuel energy flow, and/or system heat rate.

DESCRIPTION OF THE PREFERRED EMBODIMENT

Figure 1:
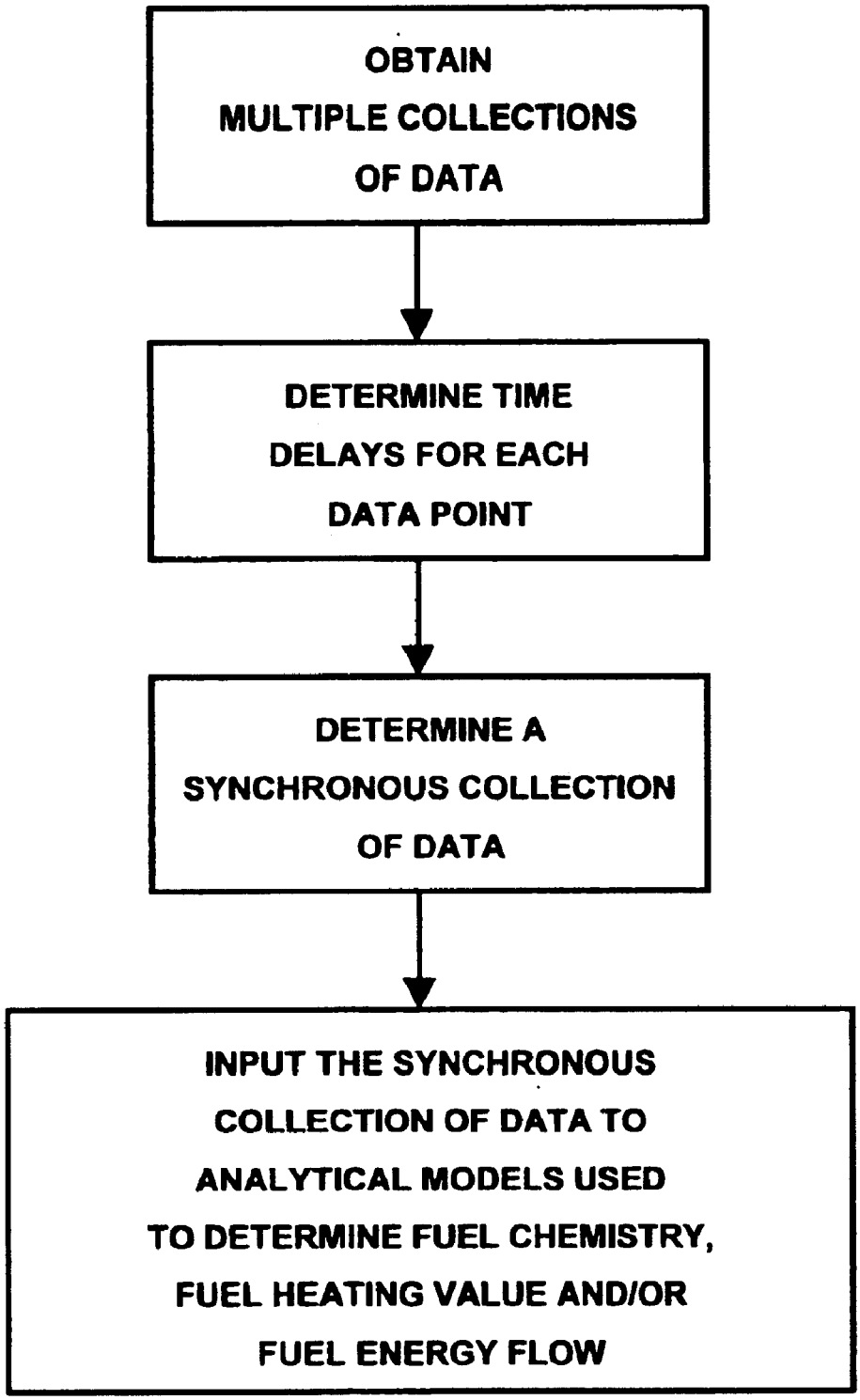
FIG. 1 is a block diagram illustrating procedures involved in data synchronization as needed by methods used to determine a fossil-fired thermal system's fuel chemistry, fuel heating value and/or its fuel energy flow.

Data synchronization may be accomplished by recognizing that within a collection of data, the single data point with the longest time delay will establish the reference time for all data input to the analytical model. This invention is taught by example. Two examples are provided, the first is discussed in the following paragraphs, the second in THE DRAWINGS (as associated with FIG. 2). The first example presents a time line of data in which the collections of data points are algebraically represented in a horizontal fashion, each row representing the same time stamp associated with its collection of data. For example, $d_{5,6}$ implies data point 5 was acquired during data collection #6 (i.e.. time stamp $t_6$). This nomenclature style is used throughout this DESCRIPTION OF THE PREFERRED EMBODIMENT section. Consider that a data collection process will time stamp a particular collection of data, for example as: $d_{1,6}$, $d_{2,6}$, $d_{3,6}$, $d_{4,6}$, $d_{5,6}$, $d_{6,6}$, $d_{7,6}$, $d_{8,6}$, $d_{9,6}$, etc. Such a data collection will have the same indicated time, $t_6$ (i.e., data collection #6, denoted by time stamp $t_6$), even though one or more of its data points could be incorrectly processed having time delays and thus associated with different time stamps. In this presentation data collection #6 is associated with a later time stamp than data collection#5, #5 later than #4, and so forth. Note that as used herein "d" refers to a single data point (and not "d" as used in '711 referencing $CO_2$); further, note that $d_{ij}$ refers to data point i collected at data collection number j. As taught by this invention, the data acquisition process must be interrogated for data collections, at $t_1$, $t_2$, $t_3$, $t_4$, $t_5$, up to $t_6$, whose data collections include the longest delayed data points found in data collection #6. To illustrate, consider that data point $d_{4,6}$ is delayed the longest by a time difference of $(t_6-t_3)$, or three data collection cycles $t_3$, $t_4$ and $t_5$ (or 3Δt). Note this implies for $d_{4,6}$ that the event of actual measurement within the system (the data gathering), which should of been associated with data collection #3, is incorrectly recorded and placed within data collection #6. Further, assume that data point $d_{2,6}$ is delayed by one data collection cycle, or $\Delta t=(t_6-t_5)$, (or 1Δt); that data point $d_{7,6}$ is delayed by two data collection cycles, or 2Δt; and that no other data point in data collection #6 is delayed. The reference time for all data input to the Input/Loss Method, or similar method, becomes data collection #6, having time stamp $t_6$, but corrected for data synchronization as taught herein. For the example presented, synchronization as taught by this invention means that the Input/Loss Method, or similar method, would be input with the following data $d_{1,6}$, $d_{2,5}$, $d_{3,6}$, $d_{4,3}$, $d_{5,6}$, $d_{6,6}$, $d_{7,4}$, $d_{8,6}$, $d_{9,6}$, etc.

In general the following data synchronization applies for data collections input to the Input/Loss Method, or similar method:

$$d_{1,\ t-n1\Delta t},\ d_{2,\ t-n2\Delta t},\ d_{3,\ t-n3\Delta t},\ d_{4,\ t-n4\Delta t},\ d_{5,\ t-n5\Delta t},\ d_{6,\ t-n6\Delta t},\ \text{etc.}$$

where:

$d_{ij}$=Data point i, collected at data collection number j;

t=Time stamp (or time) associated with the shortest, or current, data collection;

Δt=One data collection cycle (or Δtime);

n1, n2, n3, . . . =Number of data collection delays associated with data point 1, 2, 3, . . . .

The process of data synchronization applies for data which represents averaged values collected using multiple instrumentation readings over some time period, as well as to instantaneous readings of instrumentation. The frequency of instrumentation readings does not effect whether a signal is delayed relative to other signals when applying the methods of this invention. Thus these methods are applicable to real time analyses (also termed on-line analyses), and to off-line analyses.

Further, this invention makes no limitation on how data synchronization need be considered. In the example sited, data synchronization is associated with simple data collections. However, this invention also encompasses physical delays within a system's processes as time delays associated with fluid transport. For example, if the system's feedwater flow measurement has no time delay associated with the physical instrument or its recording, this invention teaches that fluid transport of feedwater through the steam generator may require a pseudo time delay to properly synchronize the feedwater flow to effluent concentration measurements, and to the system's thermodynamic conditions measured at the turbine's throttle.

Further, the process of data synchronization applies for data which is statistically smoothed with time. However, the smoothing function, typically taking the following form when determining the average of data point $d_{ij}$:

$$\bar{d}_{i,j} = (1/\Delta t_0)\int_{t}^{t+\Delta t_0} d_{i,j}\,dt$$

must be replaced with the following if any data point is delayed:

$$\bar{d}_{i,j} = (1/\Delta t_0)\int_{t+n\Delta t}^{t+\Delta t_0+n\Delta t} d_{i,j}\,dt$$

In these relationships the quantity nΔt is the number of data collection cycle delays associated with data point i; and $\Delta t_0$ is a time interval relatively large with respect to the actual data sampling time (e.g., multiples of the analog to digital conversion time period) and chosen based on individual characteristics of the data being smoothed. Other forms of data smoothing and statistical processing are known in the art, and this invention is not limited nor confined to any.

In summary, as applied in conjunction with '711, or a similar procedure, this invention teaches a method for quantifying the operation of a fossil-fired thermal system in which its fuel chemistry, fuel heating value, fuel energy flow and/or system heat rate are being determined by an analytical model using operating parameters and/or other system data, the method comprising the steps of: obtaining a set of multiple data collections, each collection consisting of individual data points describing the fossil-fired thermal system; determining a set of time delays for individual data points associated with the step of obtaining the set of multiple data collections; determining a synchronous collection of data dependent on the set of time delays for individual data points and the set of multiple data collections; and then using the synchronous collection of data in the analytical model to determine one or more of the following quantities of the fossil-fired thermal system: fuel chemistry, fuel heating value, fuel energy flow and/or system heat rate.

In summary, as applied in conjunction with '853, or a similar procedure, this invention teaches a method for quantifying the operation of a fossil-fired thermal system in which its boiler efficiency is being determined by an analytical model using operating parameters and/or other system data, the method comprising the steps of: obtaining a set of multiple data collections, each collection consisting of individual data points describing the fossil-fired thermal system; determining a set of time delays for individual data points associated with the step of obtaining the set of multiple data collections; determining a synchronous collection of data dependent on the set of time delays for individual data points and the set of multiple data collections; and then using the synchronous collection of data in the analytical model to determine the boiler efficiency of the fossil-fired thermal system.

In summary, as applied in conjunction with '956, or similar procedures, this invention teaches a method for quantifying the operation of a fossil-fired thermal system in which a L Factor or a $F_C$ Factor are used to determine an emission rate of a pollutant and/or a heat rate by analytical models using operating parameters and/or other system data, the method comprising the steps of: obtaining a set of multiple data collections, each collection consisting of individual data points describing the fossil-fired thermal system; determining a set of time delays for individual data points associated with the step of obtaining the set of multiple data collections; determining a synchronous collection of data dependent on the set of time delays for individual data points and the set of multiple data collections; and then using the synchronous collection of data in the analytical models to determine the emission rate of a pollutant and/or the heat rate of the fossil-fired thermal system

THE DRAWINGS

FIG. 1 illustrates an important portion of this invention, the determination of procedures involved in data synchronization as needed by analytical methods used to determine fossil fuel chemistry or heating value in real time. Box 100 depicts obtaining multiple collections of data; for example as obtained from a power plant's data acquisition systems. Box 102 depicts the determination of the time delays associated with each data point considering sources of possible delay such as physical measurement techniques, delays in non-uniform storage of data, etc. Box 104 depicts the determination of a collection of data which is internally synchronous; that is, the application of data synchronization techniques. Box 106 depicts the input, or otherwise use, of the synchronous data obtained from Box 104 in analytical models which determine fuel chemistry, fuel heating value and/or fuel energy flow in real time or for off-line analyses.

Figure 2:
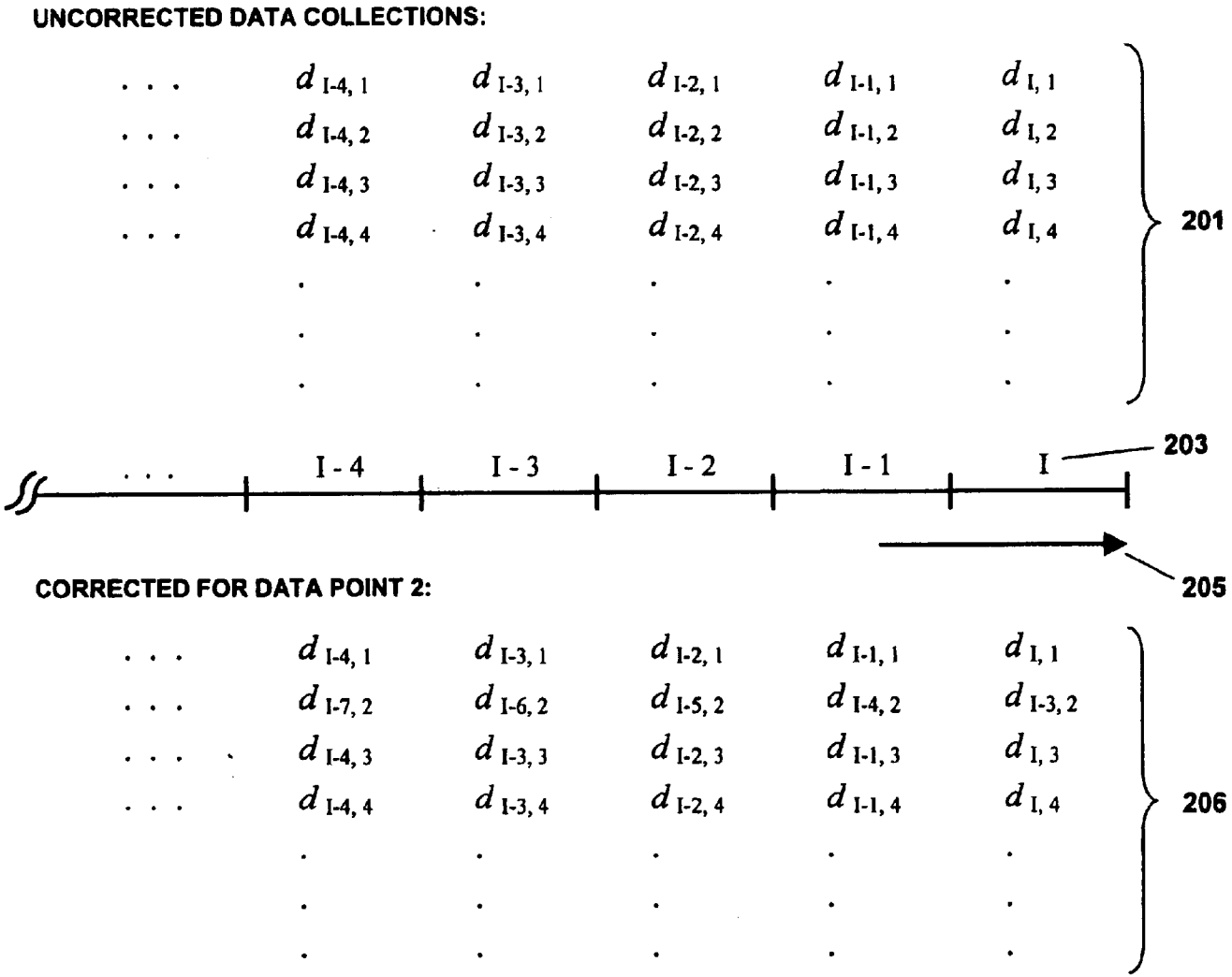
FIG. 2 is an example of data synchronization as taught by this invention, which is more fully discussed in THE DRAWINGS. In addition to the example afforded through FIG. 2, the PREFERRED EMBODIMENT contains another example with a different orientation to teaching the invention.

FIG. 2 illustrates a time line within which data collections are made. In this example, using FIG. 2, a time line of data is represented in which the collections of data points are algebraically represented in a vertical fashion, each column representing the same time stamp associated with its collection of data. For example. FIG. 2's $d_{I-3,4}$ implies data point 4 was acquired during data collection #I-3 (i.e., time stamp $t_{I-3}$). 201 denotes a series of data collections which are not corrected by the teachings of this invention. 203 is the latest available data collection, that is the most recent collection, denoted by the symbol "I". Thus the next most recent is I-1, the second most recent is I-2, and so forth. 205 indicates increasing time. 206 denotes an example of correcting data point #2 by this invention, assuming for illustration that the delay associated with data point #2 is three data collection cycles, all other data points assumed for example to have no delays; thus the corrected data collection consists of the data point $d_{I-3,2}$ associated with data collection I, $d_{I-4,2}$ with I-1, $d_{I-5,2}$ with I-2, $d_{I-6,2}$ with I-3, and so forth as illustrated.

To fully explain this invention, for FIG. 1 and elsewhere herein, if used, the words "obtain", "obtained", "obtaining", "determine", "determined", "determining" or "determination" are defined as measuring, calculating, computing, assuming, estimating or gathering from a data base. The words "establish", "established" or "establishing" are defined as measuring, calculating, computing, assuming, estimating or gathering from a data base. The term "time stamp" or "time stamped" refers to the recorded time assigned by a data acquisition process to a single data point or to a collection of data points. The term "data" when used by itself refers to a single measurement point or to multiple measurement points. The terms "data collection" or "collection of data" refers to one or more data points associated with a single grouping of similarly time stamped data. The terms "cycle" or "data collection cycle" refers to a single process of obtaining a collection of data, such data having the same time stamp. The term "collections of data" refers to multiple groups of collection of data, each group having an unique time stamp. The term "data points" refers to multiple data points. The term "data point" refers to a single data point. The term "synchronous collection of data" refers to data whose physical measurement or determination, associated with a fossil-fired thermal system, was made at essentially the same time, that is without time delay associated with any sufficient data point within that collection of data.

For FIG. 1 and elsewhere herein, the following discusses and defines meaning of the words "operating parameters" as obtained from a thermal system as applicable to this invention. Effluent $CO_2$, $O_2$, $NO_X$, and $SO_2$ measurements (at either the system's effluent stream or "smoke stack", or at the air pre-heater inlet termed the "boiler" side of the air pre-heater) are operating parameters. Indicated wet-base combustion Air/Fuel mass ratio and effluent $H_2O$ measurements, or assumptions of these terms depending on the reference fuel characteristics and appropriate error analyses, are operating parameters. Measurements comprising the Air/Fuel ratio are operating parameters. Effluent temperature, that is the average temperature associated with the combustion gases at the boundary of the system, is part of the operating parameters. The inlet/outlet ratio of $CO_2$, CO, or $O_2$ across the air pre-heater, or its assumptions, leading to the determination of a leakage factor are operating parameters. Fuel temperature at an appropriate thermodynamic boundary of the system is part of the operating parameters. Air psychrometric measurements obtained at the boundary of the system are operating parameters. The discharge temperatures of the air as it exits each air heating or cooling device (but before it reacts with the fuel) are operating parameters. Measurements required to determine the total energy flow deposition to the working fluid from the combustion gases are operating parameters. Operating parameters also include similar parameters as these, including any parameter which can directly assist in the understanding of a fossil-fired thermal system.

What is claimed is:

1. A method for quantifying the operation of a fossil-fired thermal system in which a fuel chemistry and fuel heating value of the fossil-fired thermal system are determined based on real time data acquired through a monitoring the fossil-fired thermal system, the method comprising the steps of:

selecting an Input/Loss Method which is capable of determining a complete As-Fired fuel chemistry, including fuel water and fuel ash, as a function of reference fuel characteristics, explicit mathematical models of the combustion process, a set of measurable operating parameters, an obtained effluent $H_2O$, an obtained Air/Fuel ratio, an ambient concentration of $O_2$ and an air pre-heater leakage factor, and also capable of determining a consistent As-Fired fuel heating value as a function of the complete As-Fired fuel chemistry and the reference fuel characteristics, resulting in a selected Input/Loss Method capable of determining the fuel chemistry and fuel heating value;

obtaining a set of multiple data collections, each collection consisting of individual data points describing the fossil-fired thermal system;

determining a set of time delays for individual data points associated with the step of obtaining the set of multiple data collections;

determining a synchronous collection of data dependent on the set of time delays for individual data points and the set of multiple data collections; and determining the fuel chemistry and fuel heating value of the fossil-fired thermal system based on the selected Input/Loss Method and the synchronous collection of data.

2. A method for quantifying the operation of a fossil-fired thermal system in which a boiler efficiency of the fossil-fired thermal system is determined based on real time data acquired through a monitoring of the fossil-fired thermal system, the method comprising:

selecting an Input/Loss Method which is capable of determining the boiler efficiency, said determination of the boiler efficiency comprising the concept of using a fuel's calorimetric temperature for the thermodynamic reference energy level of an Enthalpy of Products term, for the thermodynamic reference energy level of an Enthalpy of Reactants term, and also for the thermodynamic reference energy level of a Firing Correction term evaluated independent of a fuel flow and an effluent flow, said terms comprising the major terms of a computed boiler efficiency, resulting in a selected Input/Loss Method capable of determining the boiler efficiency;

obtaining a set of multiple data collections, each collection consisting of individual data points describing the fossil-fired thermal system;

determining a set of time delays for individual data points associated with the step of obtaining the set of multiple data collections;

determining a synchronous collection of data dependent on the set of time delays for individual data points and the set of multiple data collections; and determining the boiler efficiency of the fossil-fired thermal system based on the selected Input/Loss Method and the synchronous collection of data.

3. The method of claim 2, wherein the step of selecting the Input/Loss Method, includes the step of:

selecting the Input/Loss Method which is capable of determining a higher heating value boiler efficiency, said determination of the higher heating value boiler efficiency comprising the concept of using a fuel's calorimetric temperature for the thermodynamic reference energy level of an Enthalpy of Products term, for the thermodynamic reference energy level of an Enthalpy of Reactants term, and also for the thermodynamic reference energy level of a Firing Correction term evaluated independent of a fuel flow and an effluent flow, said terms comprising the major terms of a computed higher heating value boiler efficiency, resulting in the selected Input/Loss Method capable of determining the higher heating value boiler efficiency.

4. The method of claim 2, wherein the step of selecting the Input/Loss Method, includes the step of:

selecting the Input/Loss Method which is capable of determining a lower heating value boiler efficiency, said determination of the lower heating value boiler efficiency comprising the concept of using a fuel's calorimetric temperature for the thermodynamic reference energy level of an Enthalpy of Products term, for the thermodynamic reference energy level of an Enthalpy of Reactants term, and also for the thermodynamic reference energy level of a Firing Correction term evaluated independent of a fuel flow and an effluent flow, said terms comprising the major terms of a computed lower heating value boiler efficiency, resulting in the selected Input/Loss Method capable of determining the lower heating value boiler efficiency.

5. A method for quantifying the operation of a fossil-fired thermal system in which a heat rate of the fossil-fired thermal system is determined based on real time data acquired through a monitoring the fossil-fired thermal system, the method comprising the steps of:

selecting a L Factor method which is capable of determining the heat rate of the fossil-fired thermal system, said determination of the heat rate comprising the concepts of a corrected L Factor, a corrected total effluents mass flow rate and a produced electrical power, resulting in a selected L Factor method capable of determining the heat rate of the fossil-fired thermal system;

obtaining a set of multiple data collections, each collection consisting of individual data points describing the fossil-fired thermal system;

determining a set of time delays for individual data points associated with the step of obtaining the set of multiple data collections;

determining a synchronous collection of data dependent on the set of time delays for individual data points and the set of multiple data collections; and determining the heat rate of the fossil-fired thermal system based on the selected L Factor method and the synchronous collection of data.

* * * * *